60-253 SR
3/9/76 OR 3,942,319

United States Patent [19]
Sayles

[11] 3,942,319
[45] Mar. 9, 1976

[54] WATER-FREE SOLID PROPELLANT EXHAUST GASES

[75] Inventor: David C. Sayles, Huntsville, Ala.

[73] Assignee: The United States of America as represented by the Secretary of the Army, Washington, D.C.

[22] Filed: June 7, 1974

[21] Appl. No.: 478,794

[52] U.S. Cl. ..... 60/253; 60/264; 60/271
[51] Int. Cl.[2] ..... F02K 9/04
[58] Field of Search ..... 60/253, 254, 264, 271

[56] References Cited

UNITED STATES PATENTS

| | | | |
|---|---|---|---|
| 3,044,254 | 7/1962 | Adelman | 60/253 |
| 3,166,896 | 1/1965 | Breitengross, Jr. et al. | 60/264 |
| 3,195,302 | 7/1965 | Hughes et al. | 60/264 |
| 3,289,410 | 12/1966 | Balwanz | 60/264 |
| 3,292,376 | 12/1966 | Ernst et al. | 60/253 |
| 3,668,872 | 6/1972 | Camp et al. | 60/253 |

*Primary Examiner*—Samuel Feinberg
*Attorney, Agent, or Firm*—Lawrence A. Neureither; Joseph H. Beumer; Jack W. Voigt

[57] ABSTRACT

This invention disclosure relates to the incorporation of a high nitrogen-containing compound selected from tetrazole and bitetrazole in the form of a doughnut forward of the nozzle throat or in the form of a toroidal ring attached to the aft end of the nozzle exit cone. Both have been demonstrated as an effective means of reducing the quantity of water in the exhaust plume to an acceptable level which does not impart adverse effects on sensors or cause a reactive effect on the graphite constituents of the rocket nozzle. The compound, bitetrazole or tetrazole, can also be incorporated into the solid propellant where it will function similarly as a means or mechanism for water removal from the exhaust plume. Because of its contribution to the propellant's performance through the generation of near-incompressible gases, $N_2$, $H_2$ and CO, it is a desirable propellant ingredient.

10 Claims, 5 Drawing Figures

WATER-FREE SOLID PROPELLANT EXHAUST GASES

BACKGROUND OF THE INVENTION

Exhaust gases which provide the propulsion force for a propulsion system generally contain water molecules in substantial amounts. The propulsion gases may also contain particulate matter. The transmission of signals and the reception of signals by a propulsion vehicle can be greatly effected by the presence of the water molecule or particulate matter in the gases.

This invention is concerned with the problem caused by the presence of water molecules in exhaust gases from propulsion systems. The problem involves infrared radiance bands and radiance intensity of the water molecule which will seriously degrade the on-board detector's performance of certain advanced terminal interceptors.

In particular, water is recognized as being a highly undesirable constitutent insofar as its adverse effects on the long-wave infrared sensor performance is concerned. Experience has demonstrated that if the exhaust products contain more than 25% water, it would completely mask out the signal from the sensor. The masking out of the signal is very prevalent for a non-aluminized propellant of the difluoroamino type which contains 26% water in their exhaust products and of the smokeless composite propellants which contain about 37% water in their exhaust products.

An object of this invention is to provide means for the removal of water molecules from the exhaust gases of the main rocket motor and from reaction control devices of propulsion systems which employ on-board detectors whose performance is seriously degraded from the infrared bands and radiance intensity of the water molecule.

Another object of this invention is to provide a means which can serve as a propellant constituent which is reactive with the water molecule and which also acts to provide propulsion gases having high nitrogenous content and lower flame temperature.

SUMMARY OF THE INVENTION

High nitrogen-containing compounds selected from tetrazole and bitetrazole provide means for obtaining substantially water-free exhaust gases. The reaction of these compounds with water can be depicted as follows:

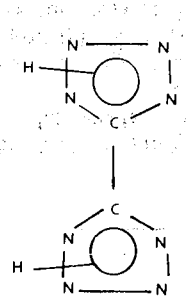

$$+ 2H_2O \rightarrow 4N_2 + 3H_2 + 2CO$$

A selected specified compound may be either incorporated into the propellant as an ingredient, affixed in the shape of a doughnut forward of the nozzle throat of a propulsion system, or affixed as a toroidal ring to the aft end of the nozzle exit cone of a propulsion system.

DESCRIPTION OF THE PREFERRED EMBODIMENTS

The means for obtaining substantially water-free solid propellant exhaust gases comprise high nitrogen-containing compounds selected from tetrazole and bitetrazole. The specified high nitrogen-containing compounds may be either incorporated into the propellant as an ingredient, affixed in the shape of a doughnut forward of the nozzle throat of a propulsion system, or affixed as a toroidal ring to the aft end of the nozzle exit cone of a propulsion system.

Figure 1:
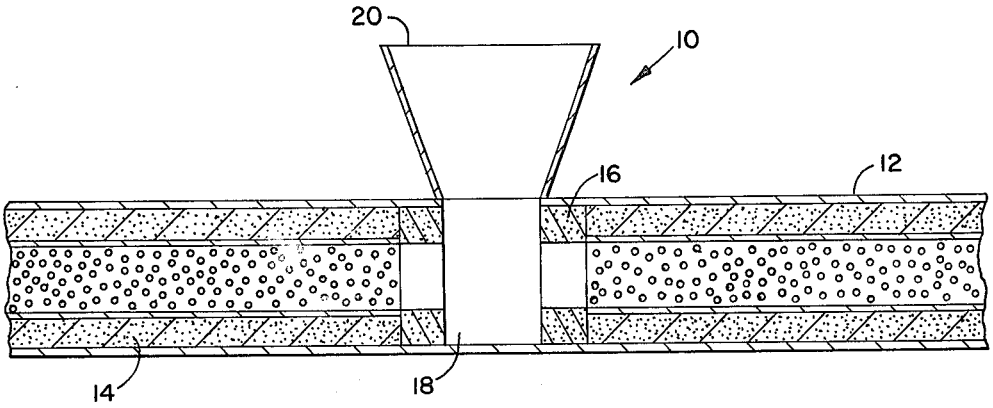
FIG. 1 is a view in section of a propulsion system utilizing an insert of a high nitrogen-containing compound, doughnut shaped, affixed forward of the nozzle throat.

Reference to the accompanying drawings are made wherein FIG. 1 depicts a T-configured propulsion system 10 which employs donut shaped structures of bitetrazole 16 forward of the nozzle throat. FIG. 1 illustrates the associated parts of the propulsion system wherein the propellant case 12 contains the solid propellant charge 14 within the case. Attached to the case is an exhaust nozzle 20. The nozzle throat 18 has in communication therewith a pair of doughnut shaped structures of bitetrazole 16 through which the propulsion system exhaust gases exit. Water molecules of the exhaust gases are involved in reactions with the bitetrazole to form gaseous products which include nitrogen, hydrogen, and carbon monoxide. The reactions result in obtaining substantially water-free exhaust gases.

Figure 2:
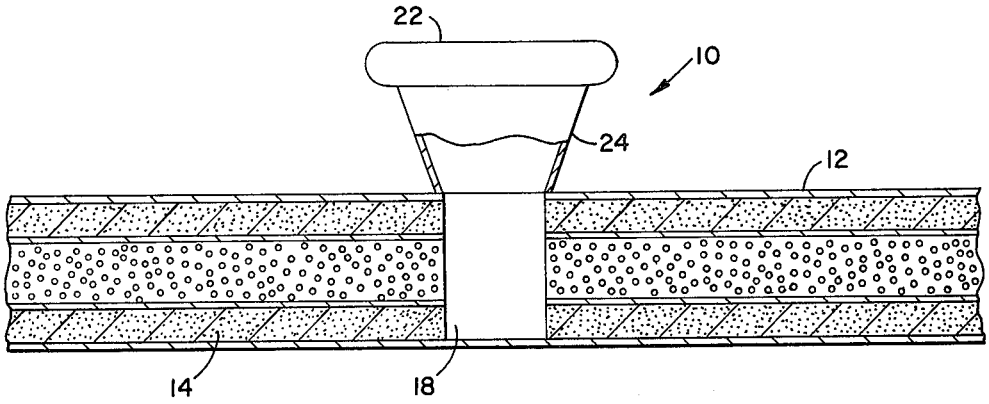
FIG. 2 is a view in section of a propulsion system utilizing a toroidal ring of a high nitrogen-containing compound, affixed to the aft end of the nozzle exit cone.

FIG. 2 illustrates a second embodiment wherein a toroidal ring of bitetrazole 22 is affixed to the aft end of the nozzle exit cone 24 of the propulsion system 10. Similarly, as in the embodiment of FIG. 1 the gases which exit from the exhaust nozzle undergo reactions with bitetrazole to yield substantially water-free exhaust gases.

Figure 3:
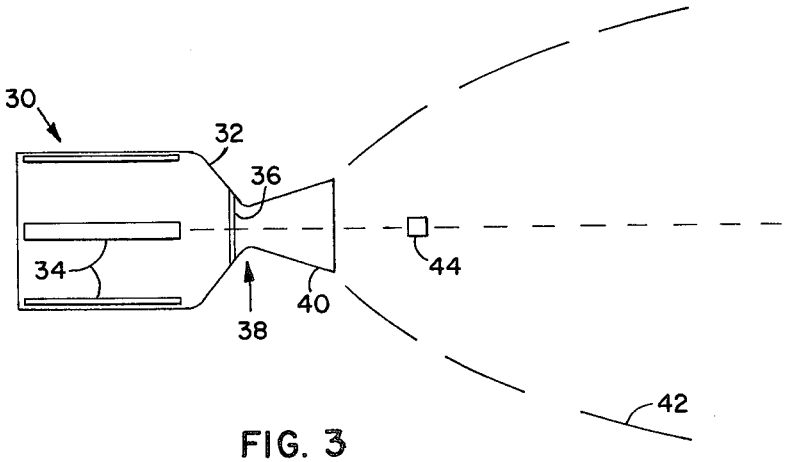
FIG. 3 is a view in section of a test rocket motor configuration for determining the influence of a high nitrogen-containing donut on the spectral scan data of propellant combustion products.

FIG. 3 depicts a test motor configuration for determining the influence of a bitetrazole donut on the spectral scan data of exhaust products of propellant. The test motor 30 comprises a rocket motor combustion chamber 32 which contains propellant web inserts 34. A bitetrazole donut 36 is shown positioned forward of the nozzle throat area 38 of the exhaust nozzle 40 which is detachably secured to the rocket combustion chamber or rocket motor case. The exhaust plume envelope is designated as 42 and a spectrometer's field of view (2-12 $\mu$m scan) is illustrated as 44. During a test procedure the spectrometer instruments are positioned in a radiometer mode in which fixed wavelength bandpass data are acquired. The instruments are positioned diametrically across the test chamber so that each act as a cold, trapped background for the other, line-of-sight variations through the plume is obtained by moving the rocket motor relative to the fields-of-view.

Figure 4:
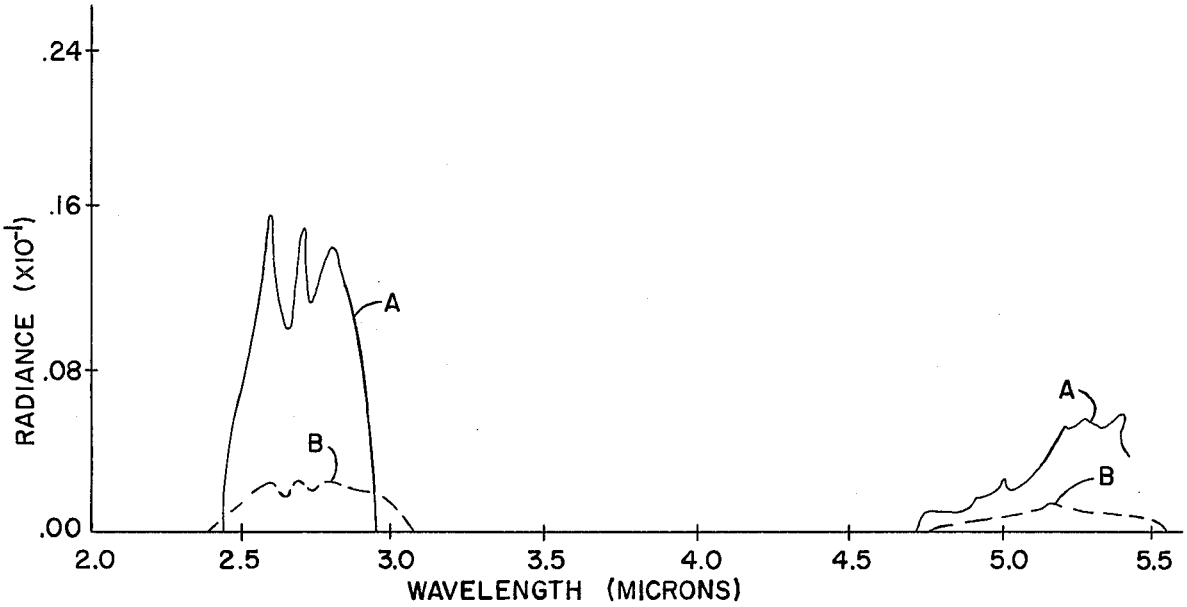
FIG. 4 is a short wave infrared spectral scan (scale of about 2-6 microns) of solid propellant exhaust products, with and without a water scavenger.

FIG. 4, curve A, depicts spectral scan data for a typical non-metallized solid propellant without a water scavenger. Curve B depicts spectral scan data for a non-metallized solid propellant using bitetrazole as water scavenger. The scan curves depict radiance $\times$ $10^{-1}$ against wavelength (microns), for range from about 2–6 microns. Radiance $\times$ $10^{-1}$ equals $W$–cm$^2$–$sr^{-1}$–$\mu m^{-1}$. Whether the curves relate to millivolt output or radiance to wavelength, the relationship of lower radiance values or lower millivolt output when the water scavenger is used is plainly illustrated. The reduction of the water molecules in the exhaust plume and the corresponding reduction in radiance provide a much needed improvement in reducing adverse effects on sensors and reducing the reactive effect on the graphite constituents of rocket nozzle.

Figure 5:
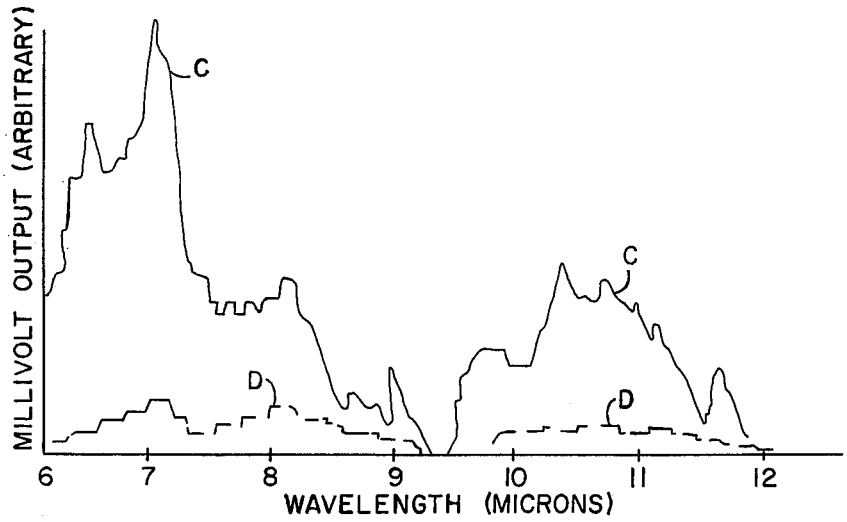
FIG. 5 is a spectral scan (scale of about 6–12 microns) of solid propellant exhaust products, with and without a water scavenger.

FIG. 5, curve C, depicts spectral scan data for a typical non-metallized solid propellant without a water scavenger. Curve D depicts spectral scan data for a non-metallized solid propellant using bitetrazole as water scavenger. The scan curves depict millivolt output (arbitrary scale) against wavelength (microns), for the range from about 6–12 microns.

Alternately, the high nitrogen-containing compounds may be employed in the propellant as an ingredient. The high nitrogen-containing compounds are energetic monopropellants which have a high positive heat of formation. Therefore, tetrazole and bitetrazole also act to provide propulsion gases with a lower flame temperature because of their high nitrogenous content.

Compression molding of the high nitrogen-containing compounds to the desired shape or molding in place to the nozzle exit cone or molding in place forward of the nozzle throat can be accomplished using standard procedures and pressures of generally in the range of from 10,000 to 20,000 psi. A compatible binder material such as a curable rubbery binder composition (e.g. polybutadiene with curatives) can be used in combination with the described molding procedure as an assist for affixing the donut or toroidal ring shaped material in place.

Representative non-metallized propellants, of the composite-modified double base, nitrogen-fluorine or polybutadiene types yield exhaust products which contain 1.0–1.5 moles of water vapor per 100 g of gaseous exit species. Thus, to tie up the water in these propellant would require $$\frac{1.0 \text{ moles } H_2O}{100 \text{ g. exhaust gases}} \times \frac{138\text{g bitetrazole}}{2.0 \text{ mole } H_2O} = 0.69 \text{ bitetrazole, i.e.}$$

0.69 g bitetrazole to tie up the water vapor calculated to be in 1 gram of the gaseous exit species. About 70 grams of bitetrazole reacts with 1 mole of water. The weight of the bitetrazole required for a particular use is readily calculated by using the above formula. By a similar formula the amount of tetrazole is likewise readily calculated. Similarly, bitetrazole or tetrazole can be employed as a propellant ingredient in the calculated amount. The amount of the water scavenger required for each propellant grain or an assembly of a multitude of grains would constitute only a fractional part of the total weight of the grain since the amount required is based on the water vapor to be reacted with. As noted earlier, additional contributions are realized from using the high nitrogen compounds in addition to the water scavenger function which they preform since the products of reactions are propulsion gases with a high nitrogenous content which means lower flame temperatures.

Because several factors influence the reduction of the signal-to-noise ratio, the amount of bitetrazole that needs to be used for a particular application does not have to be such that it reacts fully with all of the water, but it is only necessary to reduce the water content in the exhaust plume to acceptable levels.

The removal of water by scavenging it from the exhaust gases of a solid propelled rocket motor provides an additional benefit. This is so because the most reactive ingredient present in the combustion products of a propellant towards the graphite constituents of the rocket nozzle is water vapor. The reaction of steam and carbon is thermodynamically highly favored at temperatures about 3300°K (6000°F). Water is present in reasonably high concentrations in all contemporary solid propellants, namely, about 15% in aluminized, ammonium perchlorate-oxidized composite propellants, about 37% in non-aluminized, ammonium perchlorate-oxidized, smokeless composite propellants, and about 26% in TVOPA-plasticized, ammonium perchlorate-oxidized, non-aluminized difluoroamino propellants. As a consequence, removal of water from the exhaust would be highly beneficial from the standpoint of nozzle erosion and plume-sensor interactions. The plume-sensor interaction is not limited to the long wave infrared but also occurs in the short range infrared. A further discussion of the possible mechanisms of sensor interaction is given below after Table I.

The exhaust gas compositions of various types of typical propellants, both solid and liquid, are presented in Table I.

TABLE I

EXHAUST GAS COMPOSITIONS OF REPRESENTATIVE PROPELLANT TYPES

| SOLID PROPELLANT | EXHAUST CONSTITUENTS (%) | | | | | | | | |
|---|---|---|---|---|---|---|---|---|---|
| | $H_2O$ | HCl | CO | $CO_2$ | $H_2$ | HF | $Al_2O_3$ | $NH_3$ | $N_2$ |
| Difluoroamino* | 26 | 14 | 9 | 15 | | 21 | | | |
| Smokeless Composite** | 37 | 16 | 17 | 9 | 10 | | | | |
| Aluminized Composite*** | 15 | 14 | 21 | 3 | 26 | | 8 | | |
| LIQUID PROPELLANT | | | | | | | | | |
| Hydrazine | 1 | | | | 43 | | | 28 | 28 |
| Hydrogen Peroxide | 70–80 | | | | | | | | |
| Hydrazine-Nitrogen Tetroxide | 50 | | | 3 | | | | | |

TABLE I-continued

EXHAUST GAS COMPOSITIONS OF REPRESENTATIVE PROPELLANT TYPES

| SOLID PROPELLANT | EXHAUST CONSTITUENTS (%) | | | |
|---|---|---|---|---|
| Monomethylhydrazine-Nitrogen Tetroxide | 29 | 18 | 8 | 42 |

*5.21 wt % Polyethyl acrylate-acrylic acid prepolymer, 29.5% 1,2,3-tris[α,β-bis(difluoramino)ethoxy]propane (TVOPA), 1.33% 4,5-epoxycyclohexylmethyl 4′,5′-epoxycyclohexylcarboxylate (Unox 221), 1.0% Carbon, 63% ammonium perchlorate

**50.0% Nitrocellulose, 34.9% Nitroglycerin, 10.5% Diethyl phthalate/2.0% 2-Nitrodiphenylamine, 1.2% 2-Nitrodiphenylamine, 1.2% lead salicylate, 1.2% lead 2-ethyl hexoate, 0.2% Candelilla wax

***10.5% Carboxyl-Terminated polybutadiene polymer plus curatives, 2.5% n-Butylferrocene, 16.0% aluminum, 71.0% ammonium perchlorate

SENSOR SIGNAL-TO-NOISE INTERACTIONS

Two possible mechanisms by which a plume can reduce the sensor signal-to-noise ratio can be identified as: (1) impingement of exhaust constituents (gas or particles) from the attitude control systems, vernier engines, and main motors on the cold surfaces of the sensor and (2) through radiation from the particles and gases of the plume which have been excited by several different mechanisms to radiate within the sensor's wavelength region and field-of-view.

The magnitude of the reduction of the signal-to-noise ratio is dependent upon many variables, including: the composition of the propellant, the nozzle configuration, the altitude and velocity of the missile, the angle between the plume axis and the velocity vector of the missile, the optical sensor's field-of-view, and the location and orientation of the sensor relative to the nozzle. Other factors which influence the radiation from the plume include: the size of the particles produced by the solid propellant and the size of the liquid droplets from liquid propellants.

The evaluation of this invention included making measurements of the radiance from the exhaust plume of a test rocket motor as described below under the headings: "Description of the Solid Propellant Test Motor", "General Description of the Long-Wave Infrared Diagnostic Optical System", and "General Description of Motor Testing Procedures".

DESCRIPTION OF THE SOLID PROPELLANT TEST MOTOR

The test motor consists of a combustion chamber, propellant web inserts, bolt-on nozzle, nozzle closure diaphragm and ignition system. The propellant is loaded into the combustion chamber on reusable metal propellant holder inserts. Almost any grain geometry (wedges, star, cruciform, concentric cylinders, etc.) can be provided by this technique. The propellant is cut into thin strips which are approximately 35 mils thick, and bonded onto the interior surface of a cylindrical propellant holder which is then inserted into the motor combustion chamber.

GENERAL DESCRIPTION OF THE LONG-WAVE INFRARED DIAGNOSTIC OPTICAL SYSTEM

The principal radiance data is obtained with two cooled-optics long-wave infrared instruments which cover the general ranges between 6–12 and 12–24 micrometers. For these tests, these instruments are used in a radiometer mode in which fixed wavelength bandpass data are acquired. The instruments are located diametrically across the test chamber so that each acted as a cold, trapped background for the other. Line-of-sight variations through the plume are obtained by moving the rocket motor relative to the fields-of-view. Ge:Hg and Si:As detectors are used, with fixed or circular variable filters to cover the 6–12 and 12–24 micrometer wavelength ranges. The circular filters are spun at high speeds, thereby providing complete spectral scans during the 10–40 milliseconds of steady-state test-time duration in the rocket motor test chamber.

The instruments are situated on opposite sides of the diameter of the test chamber so that each served as a cold background for the other. In this manner, any performance degradation from the ideal 70°K liquid nitrogen optics and background resulted only from stray light from the room temperature tank walls. The detectors are focused onto the plume axis, and a rotating circular variable filter (CVF) is used to achieve the spectral scan. Each circular variable filter is a one-piece substrate disc which scans from 6 to 12 to 6 micrometers and from 12 to 24 to 12 micrometers in one revolution. Appropriate Ge:Hg and Si:As detectors are used. The circular variable filters are spun at 3600 rpm and, as a result, a spectrum is recorded every 8 msec. This rate is consistent with the facility test time intervals of 10–40 msec.

GENERAL DESCRIPTION OF MOTOR TESTING PROCEDURES

The testing to acquire spectral scan data on solid propellants is carried out in a simulated-altitude facility which is capable to producing the conditions existing in the exoatmosphere. The propellant is bonded onto and around the motor wall to provide a surface area of 192 $in^2$. Propellant ignition is accomplished by means of a hydrogen/oxygen mixture ($O/F = 20$) and a spark system. A series of test firings is first carried out to obtain the propellant burn surface required to produce a particular motor pressure ($Pc \sim 450$ psi) and to properly size the thickness of the mylar diaphragm needed to insure rapid ignition.

The test motor configuration for determining the spectral scan for the comparison of the various solid propellant is depicted in FIG. 3 as further described hereinabove.

I claim:

1. In combination with a solid propellant propulsion system comprised of a combustion chamber for burning propellant, a solid propellant composition contained in said combustion chamber for supplying propulsion gases as said propellant combustion is burned, and an exhaust nozzle connected to said combustion chamber for exhausting said propulsion gases, a means for reducing the quantity of water in said propulsion gases, said means comprised of a high nitrogen-containing compound selected from tetrazole and bitetrazole.

2. The combination of claim 1 wherein said high nitrogen-containing compound selected is bitetrazole.

3. The combination of claim 2 wherein said bitetrazole is in the form of a doughnut positioned forward of the nozzle throat of said exhaust nozzle.

4. The combination of claim 3 wherein said bitetrazole is in the form of a pair of doughnuts in communication with the nozzle throat of said exhaust nozzle of a T-configured propulsion system.

5. The combination of claim 2 wherein said bitetrazole is in the form of a toroidal ring attached to the aft end of the nozzle exit cone of said exhaust nozzle.

6. The combination of claim 2 wherein said bitetrazole is included in said propellant composition in a ratio of about 70 grams of bitetrazole per 1.0 to 1.5 moles of water calculated to be contained in each 100 grams of said propulsion gases that are to be exhausted from said exhaust nozzle.

7. The combination of claim 1 wherein said high nitrogen-containing compound selected is tetrazole.

8. The combination of claim 7 wherein said tetrazole is in the form of a doughnut positioned forward of the nozzle throat of said exhaust nozzle.

9. The combination of claim 7 wherein said tetrazole is in the form of a toroidal ring attached to the aft end of the nozzle exit cone of said exhaust nozzle.

10. The combination of claim 7 wherein said tetrazole is included in said propellant composition in a ratio of about 70 grams of tetrazole per 1.0 to 1.5 moles of water calculated to be contained in each 100 grams of said propulsion gases that are to be exhausted from said exhaust nozzle.

* * * * *